US007070482B2

(12) United States Patent
Montresor

(10) Patent No.: US 7,070,482 B2
(45) Date of Patent: Jul. 4, 2006

(54) MARBLE OR STONE SLAB POLISHING MACHINE PROVIDED WITH A ROTATING HEAD MOUNTED ON A FULCRUM

(76) Inventor: Nicola Montresor, 10 A Via Ugo Foscolo, 37066 Sommacampana, Verona (IT)

( * ) Notice: Subject to any disclaimer, the term of this patent is extended or adjusted under 35 U.S.C. 154(b) by 0 days.

(21) Appl. No.: 10/949,497

(22) Filed: Sep. 24, 2004

(65) Prior Publication Data

US 2005/0070213 A1 Mar. 31, 2005

(30) Foreign Application Priority Data

Sep. 29, 2003 (IT) ..... VR2003A0113

(51) Int. Cl.
*B24B 9/06* (2006.01)

(52) U.S. Cl. ..... 451/44; 451/260

(58) Field of Classification Search ..... 451/43, 451/44, 5, 11, 24, 259, 260, 261
See application file for complete search history.

(56) References Cited

FOREIGN PATENT DOCUMENTS

| | | |
|---|---|---|
| DE | 39 16 775 | 11/1990 |
| DE | 43 19 276 | 2/1994 |
| EP | 0 197 233 | 10/1986 |
| EP | 0 296 126 | 12/1988 |
| EP | 0 607 763 | 7/1994 |

*Primary Examiner*—Robert A. Rose
(74) *Attorney, Agent, or Firm*—Notaro & Michalos PC

(57) ABSTRACT

In comparison with the prior art the present machine offers many important advantages. Concerning the practicalness, the working processes are simpler and there is less wear and tear in the movable parts. Concerning the construction, the present machine avoids the utilization of the conventional supporting units needed to permit an angular movement along a curved path. As is known, the said supporting units are complex and costly.

The peculiarity of the present invention is that a head holding unit (1) comprises a plurality of motorized spindles provided with respective polishing tools or grinders (3) and is mounted at its two ends on fulcrum-type supports (4). In the present case, the supports (4) are horizontal shafts disposed on ball bearings.

20 Claims, 1 Drawing Sheet

MARBLE OR STONE SLAB POLISHING MACHINE PROVIDED WITH A ROTATING HEAD MOUNTED ON A FULCRUM

BACKGROUND OF THE INVENTION

The present invention proposes a marble or stone slab polishing machine to polish slabs made from stone, marble or the like. More particularly, the present machine is to polish the borders of slabs. The main feature of this machine is the presence of a tools holding head pivoted round a fulcrum.

More precisely, the machine according to this invention comprises a slab supporting part in which the slabs are fed on a horizontal band disposed in the front of the machine. The borders of the slabs are worked by polishing tools of heads arranged on a unit that is rotated angularly and is mounted on fulcrum supports.

In comparison with the prior art the present machine offers many important advantages. Concerning the practicalness, the working processes are simpler and there is less wear and tear in the movable parts. Concerning the construction, the present machine avoids the utilization of the conventional supporting units needed to permit an angular movement along a curved path. As is known, the said supporting units are complex and costly.

As is known, in the sector of the working of stone and marble materials several machines are utilized to perform different tasks. The main tasks are the cutting, shaping and polishing of the pieces.

Specifically, some of the said machines are utilized to shape and polish the borders of slabs made of granite, marble, stone and glazed materials.

The said machines are generally called border polishers and permit to polish the borders of slabs, for instance when it is necessary to obtain kitchen planes and shelves or surfaces provided with a toroidal border. The machine is therefore equipped with components that permit the raw slab to be subjected to the roughing and polishing operations so as to obtain a perfectly polished slab border.

The conventional slab border polishing machines are provided with a horizontal supporting plane provided with a conveyor belt. The marble or stone slab to be worked is placed on the said conveyor belt so that the slab advances progressively.

In the proximity of the rear of the machine and more precisely, beyond the conveyor belt there is a working unit provided with working and polishing tools. As the slab advances with a linear movement at a constant speed, the said tools work and polish the slab.

The working and polishing tools are represented by a series of heads. Each head is provided with a grinder. The heads are arranged side by side and in parallel succession on supports that permit the heads to be displaced angularly in respect of the working centre of the slab border.

The head supports are normally utilized in the border polishing machines and are represented by arc guides disposed on the two ends of a bar. The arc guides support suitable sliding blocks to permit an angular sliding of the bar itself. Both the sliding blocks and the arc guides are moved through independent motorized actuating systems.

The prior art discloses moving systems based on a series of connecting rods that permit the head unit to rotate like a four-bar linkage. However, in this case, the constructive structure is too complex.

It is evident that the said actuating head system is complex and expensive and involves many difficulties as concerns the construction and the operation of the machine, the costs of such machines and the costs of their operation being too high. In addition, there is a great wear and tear of the moving components.

SUMMARY OF THE INVENTION

The aim of the present invention is to eliminate the aforesaid inconveniences and in particular, to reduce the complexity of the known stone or marble working machines, specifically the slab border polishing machines, by conceiving constructive solutions that simplify the movement of the working unit so that the movement becomes more rapid and the wear and tear is reduced.

The machine according to the present invention is carried out at very low costs, also the costs of upkeep and operation being low and therefore, this machine permits to obtain practical and economic advantages.

In addition, the machine according to the present invention is equipped with a supporting unit to support the polishing heads. The said supporting unit is a kit that may be utilized in the machines of new conception as well as in the known machines because the new system fits to any type of slab border polishing machine provided with multiple heads.

All the above aims and advantages are all reached according to the present invention by a slab border polishing machine which comprises a supporting horizontal plane which is provided normally with a conveyor belt on which the slab to be worked is placed and conveyed progressively and a working unit which is provided with multiple heads which are arranged on a horizontal supporting bar and are provided with polishing grinders, characterized in that the said head supporting bar is applied, at its two ends, onto fulcra which are represented by journals the axes of which are parallel to the slab border working axis, and that the head supporting unit is maintained in a lightened condition by a system of counterbalances and is operated, for its angular displacement, by a moving system which utilizes a draw carriage which is arranged on a chain guide.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
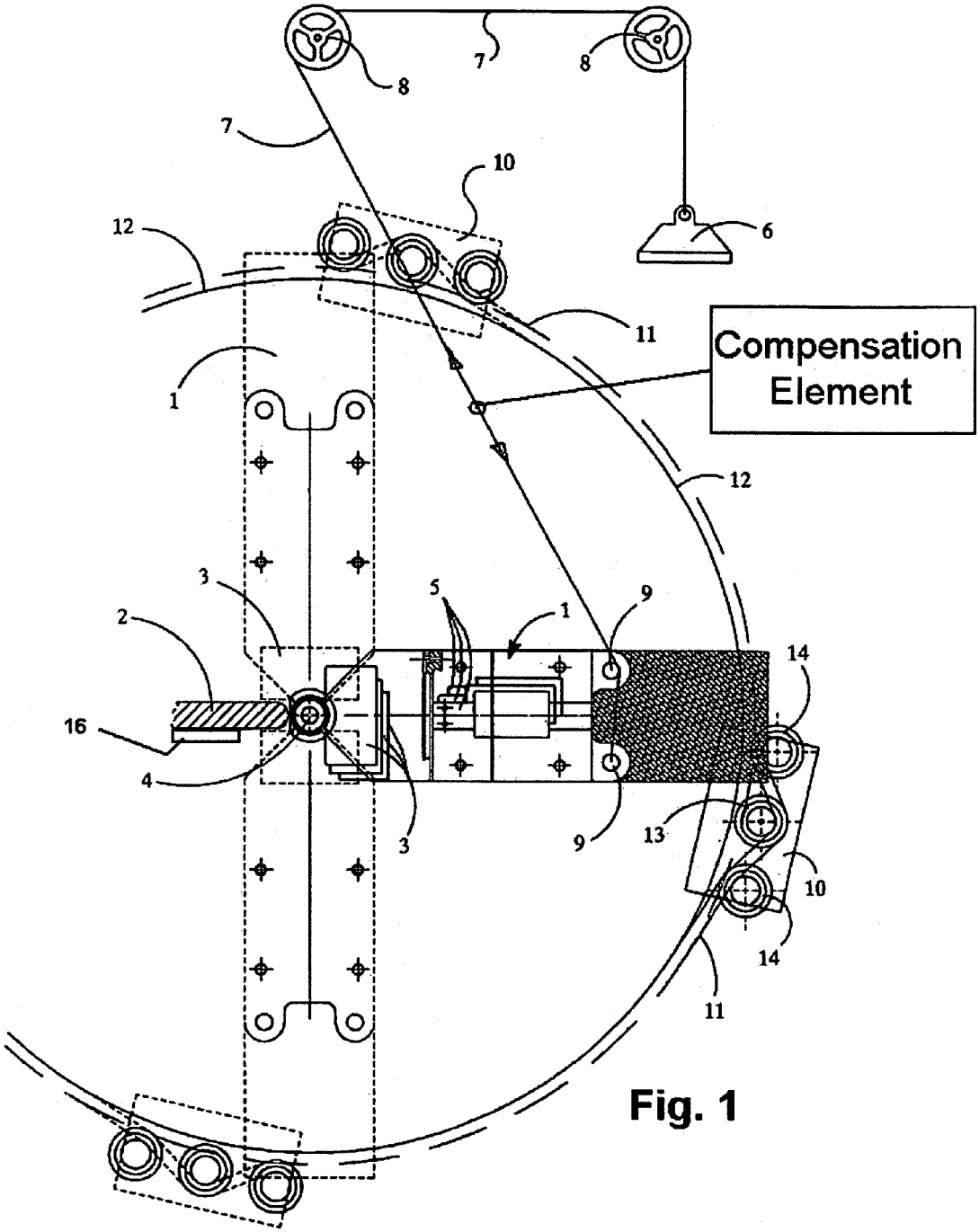
FIG. 1 is a lateral schematic view of the head supporting unit, carriage system and counter-balance system of a slab border polishing machine according to the present invention

With reference to the accompanying drawing, number 1 denotes a head supporting unit which supports angular rotation polishing heads 3. The unit 1 is moved towards a slab 2 which is fed on a conveyor belt 16 in a slab border polishing machine (not well represented for it is known).

The peculiarity of the invention is that the head supporting unit 1 comprises a plurality of motorized spindles or shafts 5 provided with respective polishing tools or grinders 3 and is mounted, at its two ends, on fulcrum-type supports 4. In the present case, the supports 4 are horizontal shafts disposed on ball bearings.

The axis of the fulcrum of the supports 4 is parallel to the axis of the toroidal sector or the like of the slab 2.

The compensations that each grinder must effect to follow the toroidal profile of the slab are effected through a pressing pneumatic device 20 disposed on the shaft 5 of the grinder 3. In practice, the grinder may be displaced along its own axis forward and backward but the grinder rests on the slab border in the whole angular movement effected by the head.

The utilization of the head unit fulcrum system is much simpler than the conventional complex system of support with sliding blocks arranged on arcuate guides and is made possible through means that permit to lighten the head.

The said means are represented by a counterbalance assembly disposed on at least one of the sides of the head supporting bar. A weight 6 of a suitable calibration is supported by a cable 7 disposed on suitable pulley transmissions 8. An end of the cable 7 is fixed to the rear of the head supporting unit in proximity of fixing points 9.

In addition, the counterbalance assembly utilizes compensation elements such as spring elements that act on the cable 7 to cause the necessary cushion of the movement.

The counterbalance system keeps the working head normally balanced with a lightening of the forces pushing the fulcrum 4. It is therefore to be noted that the utilization of the fulcrum 4, the size of which may be small, is made possible only by utilizing the system lightened by the counterbalances. Otherwise, the efforts and the thrusts of the head assembly would be excessive.

The movement of the head assembly is permitted by a carriage 10 which is connected with the head assembly. The carriage 10 is hanged among the links of a chain 11 extended on a metal arc 12.

The carriage 10 moves angularly along the chain 11 through the rotation of a motorized pinion 13 which acts on the chain 11 through two further idle pinions 14 which are arranged on the carriage 10. The chain 11 is maintained in tension on the motorized pinion 13 by means of the two idle pinions 14 which permit the chain to be gripped.

The operation of the so-described machine is the following:

Once the slab to be worked has been placed on the conveyor belt to permit the slab to advance at a constant or programmed speed towards the grinders 3, the polishing head assembly is operated and the grinders 3 begin rotating to polish the slab border.

At the same time, the angular displacing system of the polishing head assembly is operated by actuating the motorized pinion 13 so that the polishing grinders are displaced angularly in respect of the torus or other similar shape of the slab by rotating the grinders round the fulcrum 4.

The grinders rotate like an arc round the fulcrum or pivot 4 and are maintained under a constant pressure against the slab through a pneumatic or hydraulic thrust system 20 which acts on the shaft 5 of each grinder. In this way, it is possible to effect a perfect complete polishing of the slab border as the slab advances.

In addition, during the angular displacement of the polishing head assembly, the counterbalance system maintains the assembly in tension upward with a certain vertical range of the counterbalance 6 on limiting the efforts and thrusts in respect to the fulcrum 4. In this way, the wear of the fulcrum is much reduced because the structure is lightened by utilizing the counterbalances and the dragging carriage 10 hanged to the chain 11, which makes possible to utilize less powerful and much lighter motors than the conventional ones.

In addition, the above features permit to use fulcrum pivots 4 of quite small size in comparison with the structure to be supported.

Advantageously, the pivot 4 has a fixed position on the frame 30 of the machine. Otherwise, the pivot 4 is arranged on adjustable supports so as to permit the head assembly to follow the toroidal line or the like of the slab. The compensations are thus limited since it is possible to act on the shaft 5 of each of the heads.

In addition, there is the possibility of moving the head assembly with a different system from a system as described, for instance the pivot of the fulcrum 4 may be motorized or with whatever suitable device.

Finally, as already described, the supporting unit for the polishing heads may be assembled in a kit that may be utilized in the machines of new conception as well as in the known machines because the new system fits to any type of slab border polishing machine provided with multiple heads.

A technician of the field in question may also provide changes and modifications to the so-described invention and obtain solutions to be considered as included in the scope of protection of the invention as further defined in its peculiar features in the following claims.

The invention claimed is:

1. Slab border polishing machine comprising: a supporting horizontal plane with a conveyor belt on which a slab to be worked is placed and conveyed progressively; a working unit with multiple heads provided with polishing grinders and arranged on a head supporting unit having two ends; said head supporting unit applied at its two ends onto fulcra which are represented by journals, the axes of which are parallel to the slab border working axis: said head supporting unit maintained in a lightened condition by a counterbalance assembly and operated, for its angular displacement, by a moving system which utilizes a draw carriage; and said carriage connected to the head supporting unit and is hanged among the links of a chain extended on a metal arc.

2. Slab border polishing machine as claimed in claim 1, wherein the carriage moves angularly along the chain through the rotation of a motorized pinion which acts on the chain through two idle pinions which are arranged on the carriage and the chain is maintained in tension on the motorized pinion by means of the two idle pinions which permit the chain to be gripped.

3. Slab border polishing machine as claimed in claim 1 wherein said counter-balance assembly comprises a weight which is supported by a cable disposed on pulleys, an end of the cable being fixed to the rear of the head supporting unit; and said counter-balance assembly utilizing spring compensation elements which act on the cable to obtain the necessary cushion of movement of the head supporting unit.

4. Slab border polishing machine according to claim 1 wherein the compensations that each polishing grinder must effect to follow a toroidal profile of the slab are effected through a pressing pneumatic device disposed on a shaft of the grinder.

5. Slab border polishing machine according to claim 1 wherein the compensations that each polishing grinder must effect to follow a toroidal profile of the slab are effected through a pressing hydraulic device disposed on a shaft of the grinder.

6. A slab border polishing machine comprising: a means for transporting a slab having a border working axis; a frame proximate the means for transporting a slab; head supporting unit having two ends; a plurality of heads with polishing grinders mounted to the head supporting unit; a fulcrum which rotatably mounts at least one end of the head supporting unit at a single point on the frame; a means for balancing the weight of the head supporting unit; and a carriage connected with the head supporting unit and handed among the links of a chain extended on a metal arc, said carriage permitting the movement of the head supporting unit.

7. A slab border polishing machine as claimed in claim 6 wherein the heads have motorized spindles attached to the polishing grinders.

8. A slab border polishing machine as claimed in claim 6 further comprising a means for pressing the polishing grinder against the slab under constant pressure.

9. A slab border polishing machine as claimed in claim 6 further comprising a pressing pneumatic device disposed on a shaft of at least one of the heads.

10. A slab border polishing machine as claimed in claim 6 further comprising a pressing hydraulic device disposed on a shaft of at least one of the heads.

11. A slab border polishing machine as claimed in claim 6 wherein the means for balancing the weight of the head supporting unit comprises a weight which is supported by a cable disposed on pulleys and having an end which is fixed to a rear part of the head supporting unit.

12. A slab border polishing machine as claimed in claim 11 wherein the means for balancing the weight of the head supporting unit further comprises a spring operatively connected to the cable.

13. A slab border polishing machine as claimed in claim 6 wherein the means for displacing the head supporting unit comprises a carriage assembly having a carriage which is connected to the head supporting unit, the carriage movably engages a chain that extends along an arc support.

14. A slab border polishing machine as claimed in claim 13 further comprising a motorized pinion which is operatively connected to the chain and at least one idle pinion attached to the carriage wherein the cable remains in tension between the motorized pinion and the idle pinion.

15. A slab border polishing machine as claimed in claim 6 wherein the weight and cable are disposed adjacent at least one of the two ends of the head supporting unit.

16. A slab border polishing machine as claimed in claim 6 wherein the axis of the fulcrum is parallel to the axis of a toroidal sector of the slab.

17. A slab border polishing machine as claimed in claim 6 wherein the fulcrum comprises a journal with a ball bearing.

18. A slab border polishing machine comprising: a means for transporting a slab having a border working axis; a frame proximate the means for transporting a slab; head supporting unit having two ends; a plurality of heads with polishing grinders mounted to the head supporting unit; a fulcrum which rotatably mounts at least one end of the head supporting unit at a single point on the frame, the fulcrum having an axis which is parallel to the border working axis; and a carriage assembly having a carriage which is connected to the head supporting unit, the carriage hanged among the links of a chain extended on a metal arc.

19. A slab border polishing machine as claimed in claim 18 further comprising a motorized pinion which is operatively connected to the chain and at least one idle pinion attached to the carriage wherein the cable remains in tension between the motorized pinion and the idle pinion.

20. A slab border polishing machine as claimed in claim 18 further comprising a means for pressing the polishing grinder against the slab under constant pressure.

* * * * *